US011280134B2

(12) United States Patent
Puttmann

(10) Patent No.: US 11,280,134 B2
(45) Date of Patent: Mar. 22, 2022

(54) GROUND DRILLING DEVICE, METHOD FOR MAKING A GROUND DRILLING DEVICE, METHOD FOR MAINTAINING A GROUND DRILLING DEVICE, AND USE OF A GROUND DRILLING DEVICE

(71) Applicant: TRACTO-TECHNIK GmbH & Co. KG, Lennestadt (DE)

(72) Inventor: Franz-Josef Puttmann, Lennestadt (DE)

(73) Assignee: TRACTO-TECHNIK GmbH & Co. KG., Lennestadt (DE)

( * ) Notice: Subject to any disclaimer, the term of this patent is extended or adjusted under 35 U.S.C. 154(b) by 0 days.

(21) Appl. No.: 16/781,351

(22) Filed: Feb. 4, 2020

(65) Prior Publication Data

US 2020/0256126 A1 Aug. 13, 2020

(30) Foreign Application Priority Data

Feb. 11, 2019 (DE) ..... 10 2019 000 932.0

(51) Int. Cl.

| | |
|---|---|
| ***E21B 4/00*** | (2006.01) |
| ***E21B 1/00*** | (2006.01) |
| ***E21B 4/06*** | (2006.01) |

(52) U.S. Cl.

CPC ..... *E21B 4/003* (2013.01); *E21B 1/00* (2013.01); *E21B 4/06* (2013.01)

(58) Field of Classification Search

CPC ... E21B 4/003; E21B 1/00; E21B 1/16; E21B 1/38

See application file for complete search history.

(56) References Cited

U.S. PATENT DOCUMENTS

| | | | | |
|---|---|---|---|---|
| 3,865,200 | A | 2/1975 | Schmidt | |
| 4,284,147 | A | 8/1981 | Jenne | |
| 4,938,297 | A * | 7/1990 | Schmidt | E21B 4/145 173/133 |
| 5,226,487 | A | 7/1993 | Spektor | |
| 5,711,205 | A | 1/1998 | Wolfer et al. | |
| 5,794,516 | A * | 8/1998 | Wolfer | E21B 4/14 92/155 |
| 7,093,677 | B2 | 8/2006 | Hofmann | |
| 8,499,857 | B2 * | 8/2013 | Hall | E21B 47/09 175/73 |
| 2003/0024739 | A1 | 2/2003 | Runquist et al. | |
| 2010/0059284 | A1 | 3/2010 | Lyon et al. | |
| 2011/0123292 | A1 | 5/2011 | Puttmann | |
| 2014/0346840 | A1 | 11/2014 | Kahra | |
| 2017/0334052 | A1 | 11/2017 | Puttmann et al. | |

FOREIGN PATENT DOCUMENTS

| | | |
|---|---|---|
| DE | 2 157 259 | 11/1972 |
| DE | 27 56 567 A1 | 6/1979 |
| DE | 101 12 985 A1 | 10/2002 |

* cited by examiner

*Primary Examiner* — Tara Schimpf

(74) *Attorney, Agent, or Firm* — Howard IP Law Group, P.C.

(57) ABSTRACT

A ground drilling device comprising a housing, a lengthwise movable drilling head tip arranged in the housing, and a bearing for supporting the drilling head tip in the housing during its lengthwise movement.

18 Claims, 1 Drawing Sheet

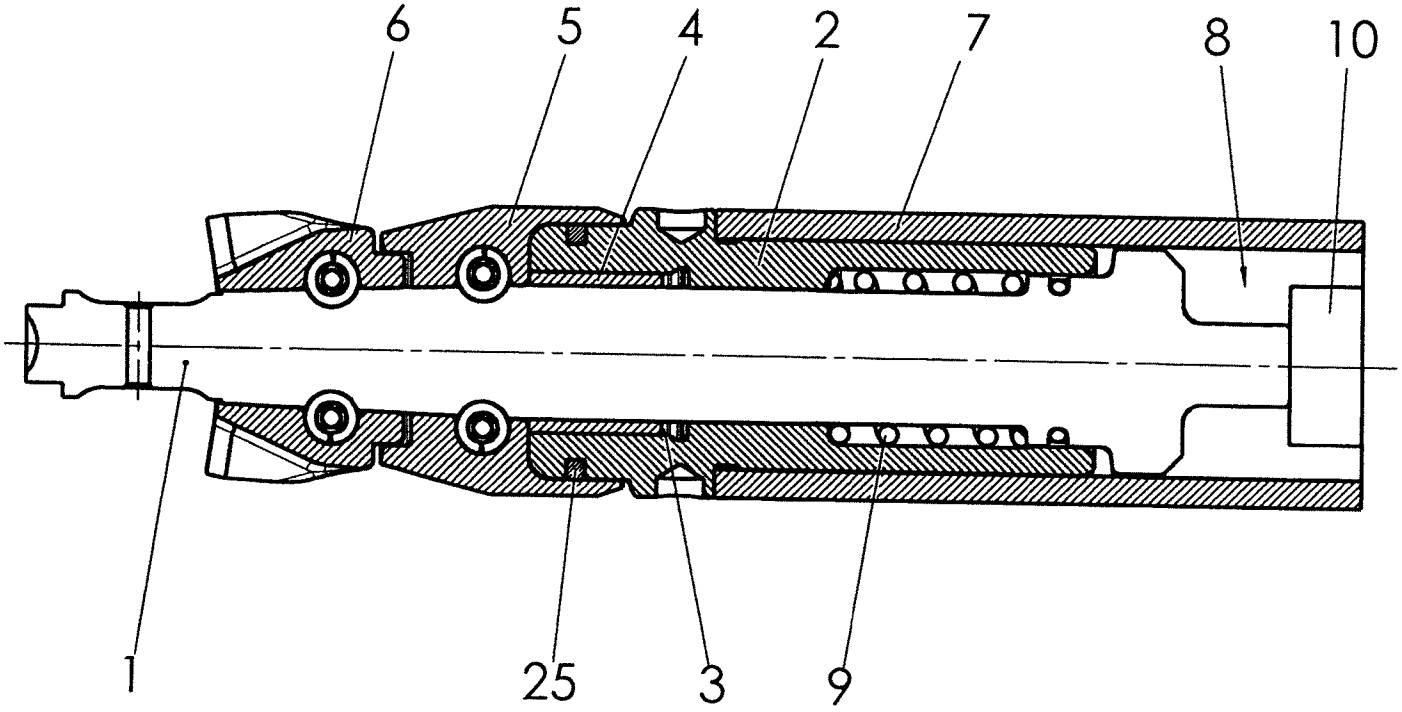
10
8
7
2
4
5
6
9
3
25
1

GROUND DRILLING DEVICE, METHOD FOR MAKING A GROUND DRILLING DEVICE, METHOD FOR MAINTAINING A GROUND DRILLING DEVICE, AND USE OF A GROUND DRILLING DEVICE

CROSS REFERENCE TO RELATED APPLICATIONS

The present application claims priority under 35 U.S.C. 119 to German Patent Application No. 10 2019 000 932.0, filed Feb. 11, 2019, the entirety of which is incorporated herein by reference for all purposes.

BACKGROUND OF THE INVENTION

Field of the Invention

The invention relates to a ground drilling device, a method for making a ground drilling device, a method for maintaining a ground drilling device, and a use of a ground drilling device.

Description of Related Art

From DE 101 12 985 A1 there is known a percussion head, having a drill bit with a striking tip and an anvil for the main piston. The drill bit is arranged in a borehole of a base, which serves at the same time as an adapter for screwing into the body of an impact device.

Although very good results are achieved with the known impact heads and a long service life can also be reached, the problem which the invention proposes to solve is to create a ground drilling device, a method for making a ground drilling device, a method for maintaining a ground drilling device, and a use of a ground drilling device, wherein an improvement is possible in regard to maintenance, service life, and/or amortization of the costs expended on such a device.

BRIEF SUMMARY OF THE INVENTION

The key notion of the invention is to provide a bearing with which the drilling head tip is supported in the housing during its lengthwise movement. In this way, it is possible to prevent the material of the drilling head tip from making direct contact with the material of the housing—unlike what occurs in the prior art. Owing to the harsh conditions prevailing in the realm of earth drilling, steel is usually employed for the drilling head tip and the housing, so that steel is rubbing against steel in the prior art and wear may be present on the rods and/or on the drilling head tip. Thanks to a bearing, the possibility is created of wear occurring on the bearing, while the wear on the housing and/or the drilling head tip can be kept low.

The invention creates a device for drilling in the soil. The device comprises a housing and a lengthwise movable drilling head tip arranged in the housing. The device moreover comprises a bearing for supporting the drilling head tip in the housing during its lengthwise movement.

The term "soil" in the sense of the present specification encompasses in particular every kind of material, especially earth, sand, rock, stone and mixed forms thereof, in which existing or yet to be produced channels or boreholes, preferably at least partly horizontal ones, especially earth channels, including earth boreholes, rock boreholes, or earth conduits, as well as underground or aboveground pipelines and water canals can be made, which can be produced or pulled in by the use of a corresponding ground drilling device.

The term "ground drilling device" encompasses any device which moves a drill string, especially one having rod sections, in an existing channel in the earth or one being created in order to produce and/or widen an earth borehole, especially a horizontal drilling (HD), and/or to pull pipelines or other elongated objects into the earth. The ground drilling device may be in particular a HD device. A ground drilling device may be in particular a device driving a drill string operating by displacing earth, and introducing the drill string into the earth by rotation and/or translation in the longitudinally axial direction of the drill string. A borehole can be introduced into the soil by pulling or pushing on the drill string.

The term "HD" (horizontal drilling) in the sense of the present specification encompasses in particular an at least partly horizontally situated borehole or channel or pipeline.

In one especially preferred embodiment, the ground drilling device may be a percussion drilling device. The term "percussion drilling device" or "displacement hammer", which is used basically synonymously with percussion drilling device, encompasses in the sense of the specification a self-propelled impact apparatus which works by displacement of soil and can introduce a borehole, a conduit, and/or a pipe into the soil by percussion. The term percussion drilling device encompasses earth displacement devices in which the drilling head tip is arranged lengthwise movably in a housing. The drilling head tip may be in particular a drill bit. A percussion drilling device can be both a single-stroke and a two-stroke device. A three-stroke device is likewise possible. A percussion drilling device can be both a single-stroke device and a device working with multiple strokes, especially a two-stroke device. In a single-stroke device, the main piston strikes the drilling head tip and at the same time the housing. In a multiple-stroke device, especially a two-stroke device, the main piston at first strikes the drilling head tip, which moves ahead during the first stroke. The housing is struck in a following stroke, especially in the second stroke. Tip resistance and casing friction are separate in a multiple-stroke device and are easier to overcome in alternating manner. In a multiple-stroke device, especially a two-stroke device, a better energy conversion can be achieved, making it easier to break up obstacles on account of the concentrating of the striking momentum at the drilling head tip. Thanks to the soil being displaced in advance according to the stroke of the drilling head tip, the housing remains at rest and thereby ensures a relatively good running stability.

The term "drilling head tip" in the sense of the specification is an element at the drilling head side, which has an outwardly directed or exposed end that comes into contact with the soil during the drilling. The drilling head tip forms the front region of the drill string, which is the first to come into contact with the soil being displaced when introducing the earth borehole into the soil. The outwardly directed end of the drilling head tip may comprise a striking tip, which can have a steplike geometry in particular and preferably have a cutting edge. The drilling head tip may have a front end geometry not tapering to a point. In particular, the drilling head tip may be a drill bit. The drilling head tip may have an end facing towards a main piston, which can be struck by the main piston (anvil end of the drilling head tip). The drilling head tip may have an adapter which is axially fixed in relation to the drilling head tip, especially a steplike adapter. Alternatively or additionally, the drilling head tip may have an adapter which is axially movable in relation to the drilling head tip, especially a steplike adapter. The drilling head tip may be pretensioned in the housing by means of a spring, especially one situated in an annular space between the drilling head tip and the housing, in order to hold the drilling head tip in its basic position or to retract it into this position. The drilling head tip may be an element with which the displacement work of the device can be performed for the drilling in the soil at the front end of the drill string. The drilling head tip is not necessarily designed as a single piece. The drilling head tip may also be formed from multiple segments, which are arranged in succession in the lengthwise direction. In one preferred embodiment, the drilling head tip is a single piece, at least in the region of the housing. Insofar as adapters are present on the drilling head tip, these can be designed as removable adapters.

The bearing in the sense of the specification is an additional element in the housing. The bearing is preferably formed not as a single piece with the housing. Even if the bearing becomes worn, the housing and the drilling head tip may still be used as long as the bearing is replaced. For the first time it has been discovered that an additional structural element affords an improvement in the sense of the problem to be solved, even though it was assumed that the providing of a bearing increases the complexity and the construction. The bearing especially in the sense of the specification is designed to be separate from the housing and/or separable from it. The bearing preferably comprises a different material than the material of the housing. The bearing can be produced or designed as a simple lathework piece. A fabrication on the lathe is easily handled, precise and cost-effective. In particular, the bearing can be a single piece. The bearing in particular may have a closed circumference, especially a closed internal circumference.

The housing in the sense of the specification may be tubular in configuration, at least for a portion. The housing may have any desired cross section, especially round, circular, and/or ellipsoidal. The housing preferably has a channel extending through the housing in the longitudinal extension, in which the drilling head tip can be arranged. The longitudinal extension of the housing and the longitudinal extension of the drilling head tip may correspond to each other. There can also be arranged in the housing a main piston, especially when the ground drilling device involves a percussion drilling device. It is possible for the housing in which the drilling head tip can be arranged to be connected to a further housing, in which the main piston—in the case of a percussion drilling device—is arranged. In the event that the housing is connected to a further housing, in which a main piston is arranged for example, and which can strike the drilling head tip, a structurizing can be provided for the connection, especially situated at the end face, on the housing for the drilling head tip, being formed to correspond to a structurizing on the housing for the main piston. The term housing may encompass a fixed shell, especially made of metal, particularly steel, enclosing the drilling head tip at least for a portion on its circumference. The housing may be, for example, part of a housing of a percussion drilling device, which can be connected to the housing in which the main piston is arranged. The housing in this sense may be a so-called front housing, which can be joined to the housing for the main piston for example by means of screwing together, gluing, shrink-fitting, or a combination of these methods. Insofar as the housing is a segment of a housing which can be connected to the housing in which the main piston is situated, the housing may have a smaller cross section than the housing in which the main piston is arranged in the area of the connection. The housing in which the drilling head tip is arranged can be inserted into the housing in which the main piston is arranged. If the housing in which the drilling head tip is arranged is inserted into the housing in which the main piston is arranged, the situation may arise from this insertion that the drilling head tip is also arranged—at least partly or at the end—in the housing in which the main piston is arranged.

In one preferred embodiment, the housing has a receiving space, in which the bearing for the drilling head tip can be arranged. In the intended condition of use, the receiving space comprises the bearing for the drilling head tip. In this way, a bearing can be provided at a defined location which is designed to support the drilling head tip in the housing during the lengthwise movement. The receiving space may be an easily produced space, for example, it can be formed by a recess in the housing. For example, the receiving space can be formed by means of turning, milling, boring, electric discharge machining, and so forth. The receiving space may be a recess in the housing, which can be fashioned as a groove and be formed at least for a portion of the circumference inside the housing. The receiving space may be formed as an annular recess in the inner contour of the housing, extending in the radial direction. The receiving space in particular may have a non-structurized or unstructurized surface, i.e., a substantially smooth surface.

In one preferred embodiment, the receiving space is accessible at the drilling head end. The receiving space may thus be accessible from the front. In terms of the movement of a ground drilling device, the front is the region which first makes contact with the soil or is the first to displace the soil. The receiving space may be accessible from the side, at a distance from the side of the housing, which is at a distance from the main piston or the anvil end of the drilling head tip. In this way, the possibility of grasping the bearing is afforded, without having to dismantle the drilling head tip and the housing. Adapters may have to be removed at the drilling head tip, but no dismantling of the housing with the drilling head tip or removal of the drilling head tip from the housing is necessary. The bearing can be simply replaced. The drilling head tip may be shoved in the direction of the main piston in order to grasp the bearing. The receiving space may be covered by an adapter arranged on the drilling head tip. Such an adapter can be fastened by means of one or more fastening bolts on the drilling head tip in a predetermined position. An adapter covering the receiving space at the front end can enclose the housing at the front end. Between the housing and the adapter there can be a seal, providing a seal against particles and/or fluid in the contact region between the housing and the adapter. In this way, it can be assured, for example, that no grime or the like can get into the receiving space.

The bearing can be held by means of an appropriate fitting in the housing. The housing and the bearing may have the same contour—the one as an inner shape and the other as an outer shape. In particular, there is an interference fit or precise fit. Alternatively or additionally, an integral bonding may be formed between the housing and the bearing, especially by means of an adhesive. For example, there is no need for a threaded connection between the bearing and the housing, which reduces the complexity of the construction and/or reduces the forces acting on the housing from the bearing. The forces acting in the longitudinal axial direction substantially parallel to the longitudinal axis between the housing and the bearing or between the bearing and the drilling head tip can be kept small, or are negligible. The bearing does not work in a direction other than the radial direction on either the housing or on the drilling head tip. The bearing in particular has no contact surface for the drilling head tip whose surface normal makes an angle greater than 20° with the longitudinal axis of the drilling head tip. The function of the bearing may be reduced to a pure bearing function for a longitudinally axis movement of the drilling head tip.

In one preferred embodiment, the bearing is a plain bearing or a roller bearing, a plain bearing being especially preferred, in which the parts moving relative to each other (the housing and the drilling head tip) have direct contact. In particular, the plain bearing can be a plain bearing with solid body friction, a plain bearing with liquid friction, or a plain bearing with mixed friction.

In one preferred embodiment, the bearing encloses the drilling head tip at least for a portion on its circumference, so that a lengthwise axial guidance is provided. The bearing for example can be simply introduced into the receiving space, so that the drilling head tip is at least partially enclosed by the bearing on its circumference.

In one preferred embodiment, the bearing is of the bushing type, especially a sliding bushing. The bearing may thus be a tubular component, which is arranged in the receiving space, and receiving the drilling head tip substantially with a precise fit. An easy handling and production of the device can be achieved in that the bearing is formed as a single piece in the shape of a bushing. The bearing as such may be easily removed as a whole and also be easily replaced once more. The bearing can be arranged in the receiving space in particular in such a way that only sliding surfaces for the drilling head tip are exposed. In particular, the bearing may be designed with no bearing surface having an orientation transversely to the longitudinal axis of the drilling head tip. The drilling head tip and the bearing may only have pairs of contact surfaces oriented substantially along the longitudinal axis of the drilling head tip. One end of the bearing facing toward the main piston may be present in the receiving space without striking another element of the drilling head, especially the drilling head tip. The bearing can be struck substantially only by outer surfaces of the drilling head tip oriented along the longitudinal axis of the drilling head tip or make contact with those surfaces.

In one preferred embodiment, the bearing comprises multiple segments, by which it is possible to achieve for example a savings on material for the bearing or different material combinations and/or lubrications over the length of the circumference by means of a liquid or lubricating agent and/or different segments. It is also possible to provide segments which are identical to each other or configured the same, which can be individually installed or replaced.

In one preferred embodiment, the bearing comprises a material which is different from the drilling head tip. For example, it may be provided that the material for the bearing is chosen to be "softer" than the material of the drilling head tip, so that the wear occurs chiefly on the bearing.

In one preferred embodiment, the bearing comprises bronze, i.e., a tin alloy, white metal, i.e. a lead/tin alloy, a lead-alloyed bearing metal, an aluminum alloy, a plastic, such as PTFE, a ceramic, which may be fiber-reinforced, or a brass alloy. Much experience has been gained with the mentioned materials, so that the handling of them can be simplified.

In one preferred embodiment, the receiving space has an extension in the lengthwise direction of the housing in the range of 10 mm to 100 mm. The dimension are chosen such that a good supporting of the drilling head tip in the housing can be achieved, yet at the same time the extension in the lengthwise direction is kept as small as possible in order to assure the access to the bearing without dismantling the drilling head tip.

In one preferred embodiment, the extension of the receiving space in the lengthwise direction of the housing in relation to the extension of the bearing in the lengthwise direction is a ratio in the range of 1.05 to 1.5. In this way, the possibility can be afforded that the receiving space is formed larger in the lengthwise direction than the bearing in the lengthwise direction, so that a clearance can be created in the receiving space, through which access can be provided to the bearing in the receiving space. For example, the clearance may be used to place an extracting tool on the bearing and to pull the bearing out from the receiving space of the housing. Preferably, the bearing can be arranged in a receiving space which is enlarged in the lengthwise direction such that the bearing is aligned flush with the side facing the front end, i.e., the front-end drilling head tip, so that the clearance is formed at the side facing away from the front end. Tolerances are possible here, so that the bearing is also arranged at the front end in the receiving space, offset from the housing. Thanks to the larger extension of the receiving space in the lengthwise direction of the housing as compared to the extension of the bearing in the lengthwise direction, the end of the bearing opposite the front end may be exposed, or it can be accessed.

In one preferred embodiment, the internal diameter of the housing outside the bearing is oversized in relation to the external diameter of the drilling head tip, so that a preponderant supporting of the drilling head tip by the bearing is achieved. In the area outside of the bearing, the oversizing creates the possibility of the least possible contact between the drilling head tip and the housing, being concentrated on the bearing.

In one preferred embodiment, the bearing is held in the housing by means of a press-fit or a glued press-fit. In this way, an especially simple connection between the bearing and the housing can be made possible. In particular, no screw connection has to be loosened. For the loosening or removing of the bearing, the bearing can be grasped with an extracting tool behind the bearing in order to separate the bearing from the housing for its replacement or to pull it out from the receiving space. Accordingly, the drilling head tip, especially when any adapters have been removed, can be pushed into the housing far enough so that the bearing can be grasped. The grasping is done in particular from the end of the bearing facing toward the main piston. An extracting tool can be attached here and can pull out the bearing.

The invention also creates a method for making a ground drilling device, as is described above for example. The method for making the device involves the steps: providing a housing and providing a lengthwise movable drilling head tip in the housing and arranging the drilling head tip in the housing. A bearing for the drilling head tip is introduced between the housing and the drilling head tip for the lengthwise movement. The previous remarks on the aspect of the ground drilling device apply analogously to the aspect of the method.

The invention also creates a method for maintaining a ground drilling device, especially as described above, wherein the method involves the steps: providing a device comprising a housing and a lengthwise movable drilling head tip in the housing; grasping a bearing which is arranged between the housing and the drilling head tip, and pulling out the bearing. By the term "grasping" is meant a removing of the bearing and/or an inserting of the bearing, which describes a removal of the bearing from the housing in connection with the pulling out of the bearing, wherein the bearing can be separated from the housing without loosening a screw connection. The aspect of the method for maintaining a ground drilling device analogously concerns the remarks on the aspect of the ground drilling device itself. The resulting design and configuration of the device is also mirrored in the method for maintenance. For example, the method for maintaining a ground drilling device may also involve in particular a grasping of a bearing accessible at the drilling head side.

The invention also creates a use of a ground drilling device, which comprises a housing and a lengthwise movable drilling head tip arranged on the housing, and using a bearing for the drilling head tip.

In the sense of the specification, the indication of a numerical value encompasses not only the actual numerical value, but also a range about the specific numerical value which may be +/−15%, preferably +/−10%, of the indicated numerical value—in order to allow for fabrication tolerances, in particular.

The term "comprise" in the sense of the specification encompasses both the inherent meaning of the term, that further elements may be provided besides the elements mentioned (a non-exhaustive listing), but also the meaning that the term "comprise" is used synonymously with "consist of" and "formed from".

The preceding remarks, just as the following description of exemplary embodiments, do not constitute any abandonment of particular embodiments or features.

The invention shall now be explained more closely with the aid of an exemplary embodiment presented in the drawing.

BRIEF DESCRIPTION OF THE DRAWINGS

The drawing shows:

FIG. 1 a region of a ground drilling device at the drilling head end.

DETAILED DESCRIPTION OF THE INVENTION

FIG. 1 shows a section of a ground drilling device at the drilling head end. A drilling head tip 1 is present, which is arranged in a housing 2. For the supporting of the drilling head tip 1, a receiving space 3 is formed in the housing 2 at the end side. The receiving space 3 is accessible from the drilling head end, i.e., from the front. In the receiving space 3 there is arranged a bearing 4. The receiving space 3 with the bearing 4 is covered at the front end by means of an adapter 5 secured to the drilling head tip 1. Moreover, another lengthwise axially movable adapter 6 is provided, which is likewise connected to the drilling head tip 1. If the adapters 5 and 6 are removed, access can be gained to the bearing 4 in the receiving space 3 without having to dismantle the drilling head tip 1. An annular seal 25, arranged in a corresponding groove, is provided for the sealing between adapter 5 and housing 2.

The housing 2 is connected to a housing 7 in which a main piston 10 is arranged. The drilling head tip 1 has an exposed end, which comes into contact with the soil. At the end opposite the end of the drilling head tip 1 exposed to the soil there is formed an anvil 8, which can be struck by the main piston 10.

An annular spring 9 is provided for pretensioning the drilling head tip 1 relative to the housing 2, being arranged between the drilling head tip 1 and the housing 2.

The invention claimed is:

1. Ground drilling device, comprising a housing, a lengthwise movable drilling head tip arranged in the housing, and a bearing arranged within a receiving space comprising a recess on an inside surface of the housing and open at a front end of the housing, the bearing configured for supporting the drilling head tip in the housing during its lengthwise movement.

2. Device according to claim 1, wherein the receiving space is configured to receive the bearing for the drilling head tip and is accessible at the drilling head end.

3. Device according to claim 2, wherein the receiving space has an extension in the lengthwise direction of the housing in the range of 10 mm to 100 mm.

4. Device according to claim 3, wherein the extension of the receiving space in the lengthwise direction of the housing in relation to an extension of the bearing in the lengthwise direction is a ratio in the range of 1.05 to 1.5.

5. Device according to claim 1, wherein the device is a percussion drilling device.

6. Device according to claim 1, wherein the bearing encloses the drilling head tip at least for a portion on a circumference of the drilling head tip.

7. Device according to claim 1, wherein the bearing comprises multiple segments.

8. Device according to claim 1, wherein the bearing comprises a material which is different from the drilling head tip.

9. Device according to claim 1, wherein an internal diameter of the housing outside the bearing is oversized in relation to the external diameter of the drilling head tip.

10. Device according to claim 1, wherein the bearing is held in the recess of the housing by means of a press-fit or a glued press-fit.

11. Device according to claim 1, wherein the receiving space has an extension in the lengthwise direction of the housing greater than an extension of the bearing in the lengthwise direction, and wherein a portion of the receiving space beyond the bearing is accessible from a side of the housing.

12. Device according to claim 1, wherein a flange on the drilling head tip and an end of the housing are arranged rearward of the receiving space to retain the drilling head tip in the housing.

13. Method for making a ground drilling device, comprising the steps of:

providing a housing comprising a receiving space comprising a recess on an inside surface of the housing and open at a front end of the housing, providing a lengthwise movable drilling head tip in the housing and arranging the drilling head tip in the housing, and arranging a bearing for the drilling head tip within the receiving space of the housing between the housing and the drilling head tip for supporting the drilling head tip in lengthwise movement while the drilling head tip is arranged in the housing.

14. The method of claim 13, wherein the receiving space has an extension in the lengthwise direction of the housing greater than an extension of the bearing in the lengthwise direction, and wherein a portion of the receiving space beyond the bearing is configured to be accessed from a side of the housing while the drilling head tip is installed in the housing.

15. The method of claim 13, further comprising arranging a flange on the drilling head tip and an end of the housing rearward of the receiving space to retain the drilling head tip in the housing.

16. Method for maintaining a ground drilling device, comprising the steps of:

providing a housing comprising a receiving space comprising a recess on an inside surface of the housing and open at a front end of the housing with a lengthwise movable drilling head tip in the housing, grasping a bearing which is arranged within the receiving space of the housing for supporting the lengthwise movement of the drilling head tip, and pulling the bearing out while the drilling head tip is arranged in the housing.

17. The method of claim 16, wherein the receiving space has an extension in the lengthwise direction of the housing greater than an extension of the bearing in the lengthwise direction, and wherein pulling out the bearing comprises accessing a portion of the receiving space beyond the bearing from a side of the housing to pull out the bearing.

18. The method of claim 16, wherein providing the housing further comprises providing the housing such that a flange on the drilling head tip and an end of the housing are arranged rearward of the receiving space to retain the drilling head tip in the housing during maintenance of the bearing.

* * * * *